US007431410B2

(12) United States Patent
Sato et al.

(10) Patent No.: US 7,431,410 B2
(45) **Date of Patent: *Oct. 7, 2008**

(54) SLIDING ASSISTING APPARATUS

(75) Inventors: Hiroji Sato, Tokyo (JP); Yasutomo Kobayashi, Yamato (JP); Takefumi Tsuchiya, Zushi (JP)

(73) Assignee: Nifco Inc., Yokohama-Shi, Kanagawa (JP)

( * ) Notice: Subject to any disclaimer, the term of this patent is extended or adjusted under 35 U.S.C. 154(b) by 486 days.

This patent is subject to a terminal disclaimer.

(21) Appl. No.: 11/177,306

(22) Filed: Jul. 11, 2005

(65) Prior Publication Data

US 2006/0017359 A1 Jan. 26, 2006

(30) Foreign Application Priority Data

Jul. 21, 2004 (JP) ..... 2004-213628

(51) Int. Cl.
*A47B 88/00* (2006.01)

(52) U.S. Cl. ..... 312/333

(58) Field of Classification Search ..... 312/333, 312/334.44, 334.46, 334.27, 319.1, 334.1, 312/334.7; 384/21, 19; 188/82.1; 16/64, 16/96 R, 54, 50, 354

See application file for complete search history.

(56) References Cited

U.S. PATENT DOCUMENTS

| | | | | |
|---|---|---|---|---|
| 345,227 | A * | 7/1886 | Fraser | 312/334.32 |
| 6,039,421 | A * | 3/2000 | Fulterer | 312/333 |
| 6,398,327 | B1 * | 6/2002 | Momoze | 312/319.1 |
| 6,848,759 | B2 * | 2/2005 | Doornbos et al. | 312/319.1 |
| 7,028,370 | B2 * | 4/2006 | Hoshide et al. | 16/96 R |
| 7,185,959 | B2 * | 3/2007 | Mueller et al. | 312/331 |
| 7,240,978 | B2 * | 7/2007 | Kobayashi et al. | 312/333 |
| 7,281,773 | B2 * | 10/2007 | Sato et al. | 312/333 |
| 2002/0096405 | A1 * | 7/2002 | Gasser | 188/82.1 |
| 2003/0067257 | A1 * | 4/2003 | Gasser | 312/331 |
| 2004/0104649 | A1 * | 6/2004 | Muller et al. | 312/333 |
| 2005/0218759 | A1 * | 10/2005 | Kobayashi et al. | 312/331 |
| 2006/0016279 | A1 * | 1/2006 | Sato et al. | 74/89.17 |
| 2007/0114896 | A1 * | 5/2007 | Orita | 312/334.14 |

FOREIGN PATENT DOCUMENTS

| | | | |
|---|---|---|---|
| EP | 1188397 | A1 | 3/2002 |
| EP | 1350443 | A1 | 10/2003 |
| GB | 1500767 | A | 2/1978 |
| JP | 02-286102 | | 11/1990 |

* cited by examiner

*Primary Examiner*—Janet M Wilkens
(74) *Attorney, Agent, or Firm*—Manabu Kanesaka

(57) ABSTRACT

A sliding assisting apparatus for assisting a sliding operation wherein a movable body slidably engaged with a base is slid between a first sliding position and a second sliding position includes sliders, a spring member, lock members and operation members. The sliders are engaged with the movable body and capable of sliding in the same one or more directions as the movable body. The spring member is capable of accumulating force in the sliding operation of the movable body and connecting the respective sliders together. The lock members are each capable of engaging with one of the sliders to exert the accumulated force on the slider, and disengaging from the slider to release the accumulated force from the slider. Operation members are each capable of engaging and disengaging with the lock member for engaging the lock member with a slider and disengaging a lock member from the slider.

9 Claims, 7 Drawing Sheets

(b)

(c)

(d)

SLIDING ASSISTING APPARATUS

BACKGROUND OF THE INVENTION AND RELATED ARTS STATEMENT

The present invention relates to a sliding assisting apparatus for assisting the sliding operation of a movable body, for example, such as a drawer in either direction between a drawn-in position and a drawn-out position on a base.

As exemplified in Japanese Examined Patent No. H5-023763, in a structure in which a movable body is switched to slide between a drawn-in position and a drawn-out position on a base, it may be tiresome for the user and lack device overall quality and functionality if all the switching operations for sliding in the drawing-in direction and sliding in the drawing-out direction are performed by hand. In the JP H5-023763 reference, to overcome a design such that the movable body is forced in either direction of the drawn-out position or the drawn-in position, the device may be slid automatically toward a forced direction.

FIGS. 10(*a*) and 10(*b*) respectively show the apparatus for a drawer in JP H5-023763. FIG. 10(*a*) is a state drawing of the drawn-in position of a movable body (not shown). FIG. 10(*b*) shows the drawn-out position of the same device. In these figures, item 50 is a side wall of the base, item 55 is a drive pin on the side of the movable body, item 60 is a tilting part placed between the base side wall and the movable body, and item 65 is a spring member.

A guide track 51 is provided on the base side wall 50. The guide track 51 includes a straight part 51*a*, which extends horizontally in the front-to-back direction, and a bow-shaped part 51*b*, on the front side of the device (right side in the figure). The tilting part 60 has a slot 61 which is open at the top, and a diagonal side wall 62 which extends from the front side of the slot 61, and two bolts 63 coupled in the guide track 51.

The spring member 65 accumulates force in the course of the sliding of the movable body from the drawn-in position to the drawn-out position, where one end is fixed on the side of the base and the other end is fixed on the tilting part 60. Also, in this structure, the movable body is built into the side of the base where the drive pin 55 is coupled in the slot 61.

When the movable body is slid from the drawn-in position to the drawn-out position, the tilting part 60 is moved following the straight part 51*a* of the guide track 51, and then it is tilted forward at the bow-shaped part 51*b*. Also, the drive pin 55 moves from the slot 61 to the diagonal side wall 62. In this manner, the movable body is checked or locked in the drawn-out position in opposition to the force of the spring member 65. Also, by being pushed backward, the moveable body is drawn in by the force accumulated in the spring member 65 after the drive pin 55 is returned from the diagonal wall part 62 to the slot 61.

In the JP H5-023763 reference, the design is such that the movable body is slid to the drawn-in position by the force of the spring member 65, eliminating the problem that the movable body may bound and be drawn out again when drawn in with a strong force.

In the above-mentioned conventional structure, for example, although the movable body is slid automatically almost entirely from the drawn-out position to the drawn-in position, a strong pulling operation force by this amount is required in going from the drawn-in position to the drawn-out position, making it inconvenient for the user. Also, the drive pin 55 is made to escape from the slot 61 by the forward tilting of the tilting member 60 and is coupled with the diagonal side wall 62 as a lock mechanism for locking the movable body in opposition to the force of the spring member 65. This causes a poor coupling force and the potential that the lock may be released due to vibrations, and the like.

Because the opening of the slot 61 provided on the tilting member 60 is subject to a great load accompanying the accumulation of force of the spring member 65 during the drawing-out operation of the movable body (drive pin 55), it would be desirable to make the lock gear with the drive pin 55 larger. However, a constraint exists in that it must be made such that the release of the coupling of the drive pin 55 accompanying forward tilting of the tilting member 60 also is not impeded. Also, the conventional structure is limited in the operational characteristics in that it does not have functions for assisting both operations of the case when sliding the movable body in the direction of the drawn-in position and when sliding it in the direction of the drawn-out position.

The purpose of the present invention is to eliminate problems such as the above, for example, by enabling diverse methods that may be used by a comparatively simple structure, and to improve the convenience of use, and high quality of the apparatus to which it is applied.

SUMMARY OF THE INVENTION

The disclosed embodiments, as illustrated in FIGS. 1-3, provide a sliding assisting apparatus for assisting a one-way sliding operation (drawing-in operation) where a movable body is attached so that it may slide on a base and be slid from a first sliding position to a second sliding position (drawn-in position). In addition, the movable body may be slid by a sliding operation (drawing-out operation) where it is slid from the second sliding position (drawn-in position) to the first sliding position.

In particular, a sliding assisting apparatus for assisting a sliding operation wherein a movable body slidably engaged with a base is slid between a first sliding position and a second sliding position. The device includes a plurality of sliders engaged with the movable body and capable of sliding in the same one or more directions as the movable body. A spring member is capable of accumulating force in the sliding operation of the movable body and connects the respective sliders together. One or more lock members are each capable of engaging with one of the sliders to exert the accumulated force on the slider, and capable of disengaging from the slider to release the accumulated force from the slider. One or more operation members are each capable of engaging and disengaging with a lock member for engaging the lock member with a slider and disengaging the lock member from a slider.

In an embodiment, a first of the sliders is positioned on top of a second of the sliders. In a related embodiment, during the sliding operation between a first midcourse position and a second midcourse position, a first lock member is engaged with the first slider and a second lock member is engaged with the second slider. In a second related embodiment, during the sliding operation between a drawn-out position and a first midcourse position, a first lock member is disengaged from the first slider and a second lock member is engaged with the second slider. In yet another related embodiment, during the sliding operation between a second midcourse position and a first drawn-in position, a first lock member is engaged with the first slider and a second lock member is disengaged from the second slider.

The disclosed embodiments of the present invention offer numerous advantages. The above noted structure permits sliding between a midcourse position and a fully drawn-out position, or between a midcourse position and a fully drawn-in position, automatically by the force of the spring member, offering tremendous improvement from the viewpoint of convenience and ease of use. Also, because both assisting functions for the sliding operations, namely in both the drawing-in and drawing out directions can be achieved by a single unit construction, it has the advantage of providing excellent building-in characteristics and maintenance characteristics, tending not to limit the device setup space.

DETAILED DESCRIPTION OF PREFERRED EMBODIMENTS

Figure 1:
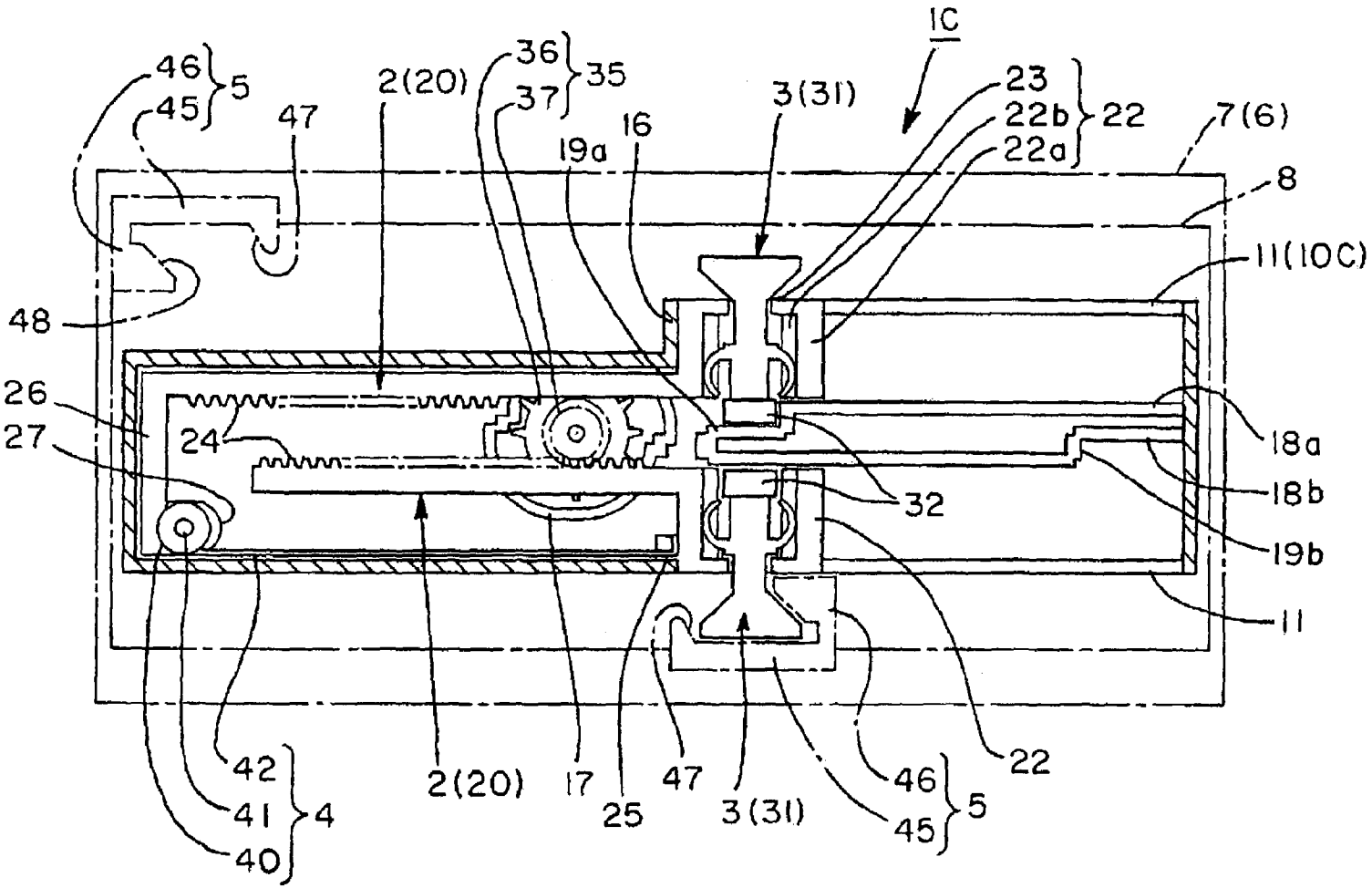
FIG. 1 is a typical structural drawing showing in section a case of a sliding assisting apparatus of a first working example.
Figure 2A:
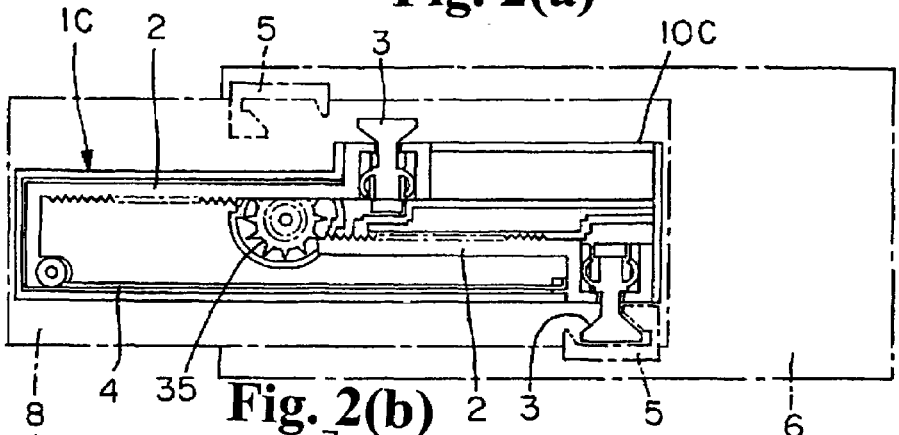
FIG. 2 is a typical operational drawing showing the operation of the apparatus in FIG. 1.
Figure 2B:
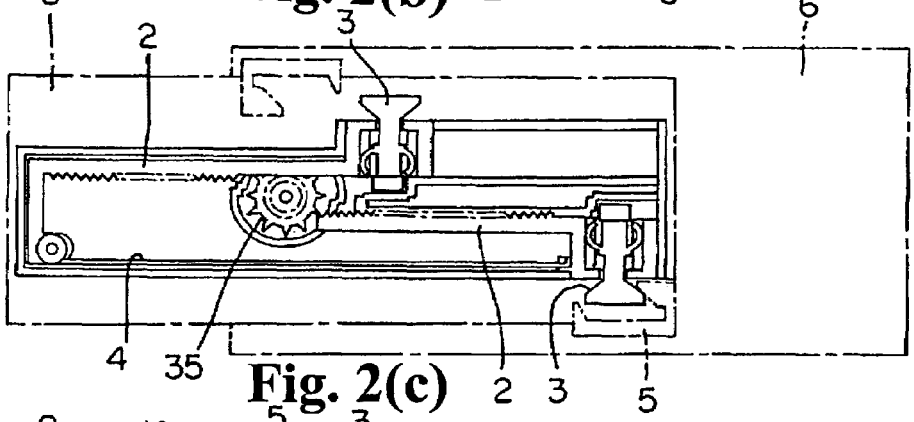
Figure 2C:
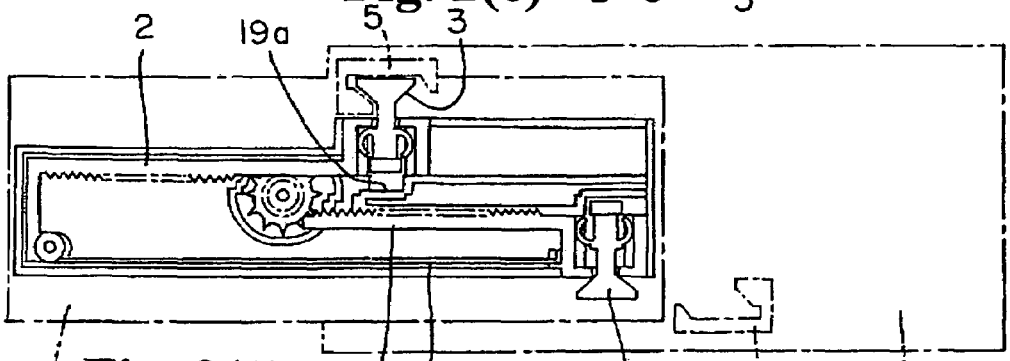
Figure 2D:
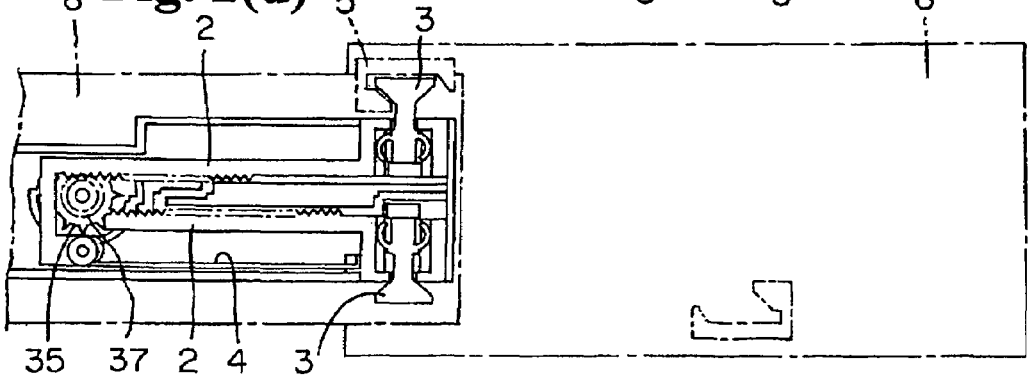
Figure 3A:
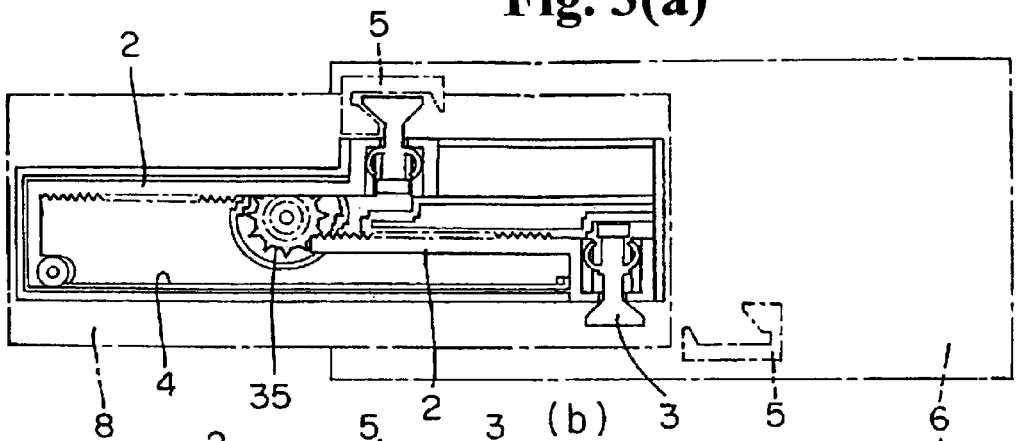
FIG. 3 is a typical operational drawing showing the operation of the apparatus in FIG. 1 as illustrated in FIG. 2.
Figure 3B:
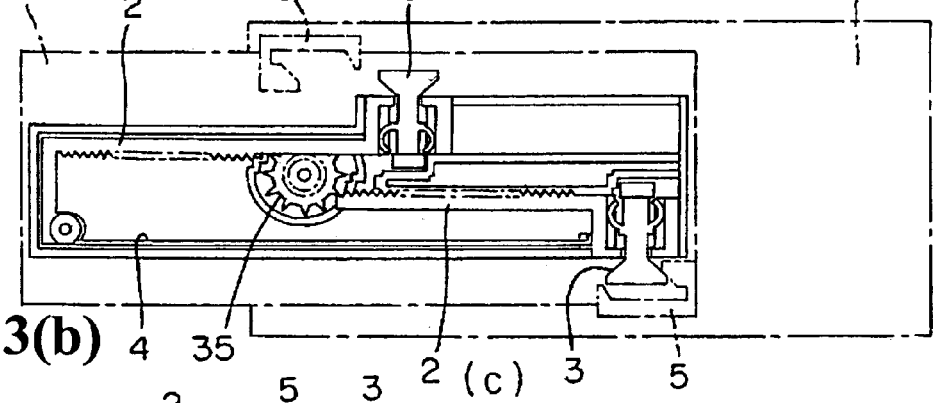
Figure 3C:
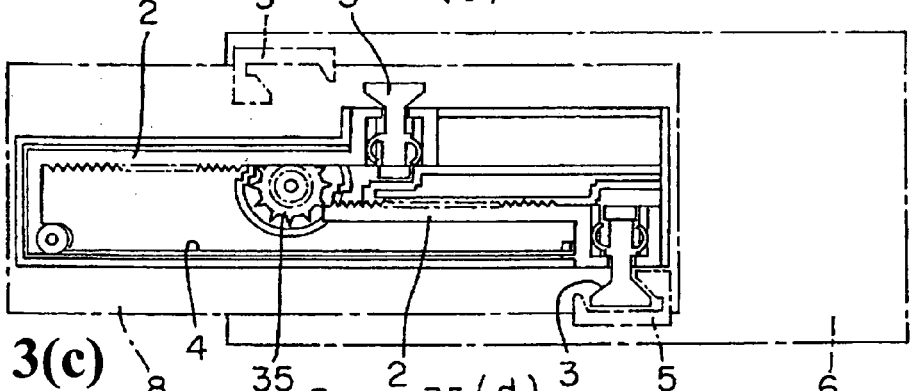
Figure 3D:
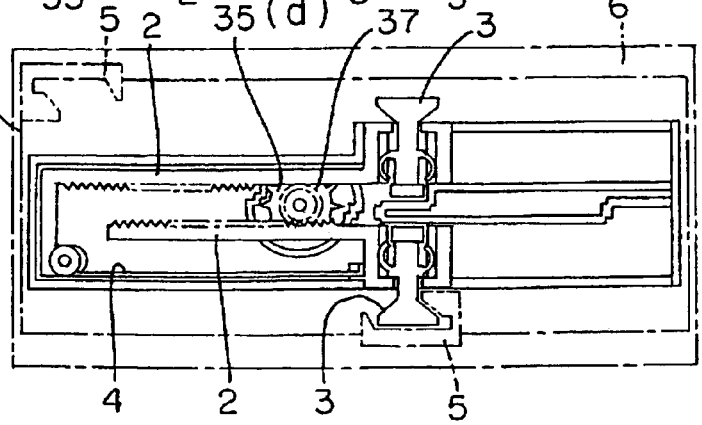

Preferred embodiments of the present invention are explained while referring to the working examples in the drawings. In the drawings, FIGS. 1-4 show a first working example.

Beginning with FIG. 1, the figure shows a typical structural drawing showing in section a case of a sliding assisting apparatus. FIG. 2 shows a typical operational drawing showing the operation of the apparatus in FIG. 1. FIG. 3 shows a typical operational drawing showing the operation of the apparatus in FIG. 1 as illustrated in FIG. 2. and FIG. 4 shows a reference drawing showing the relationships, and the like, of the movable body and the base in FIG. 1.

Figure 5:
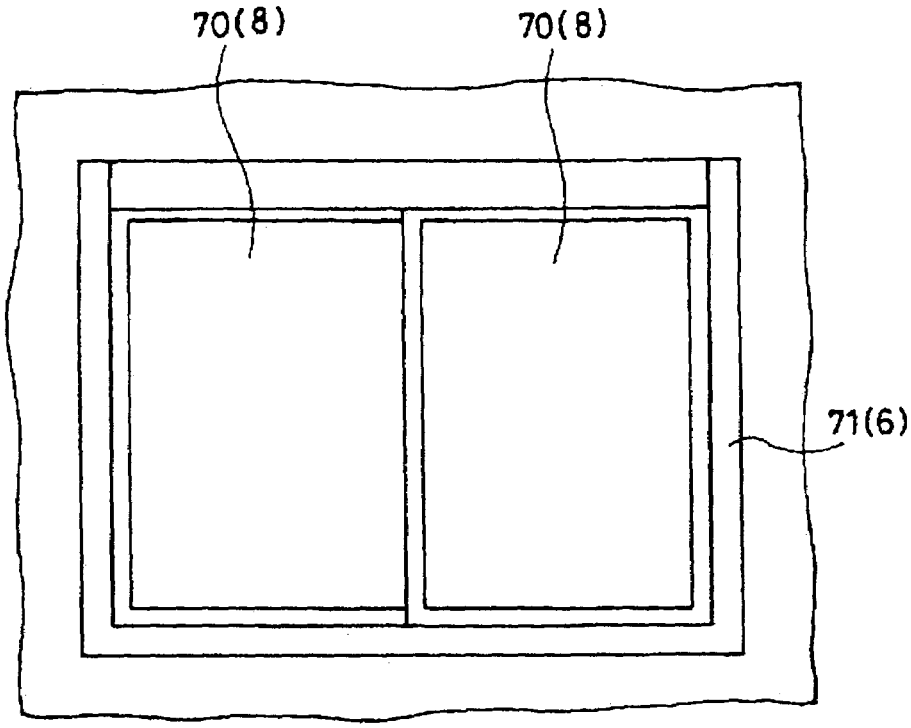
FIG. 5 shows a second working example, and the same drawing is a front view of a window.
Figure 6:
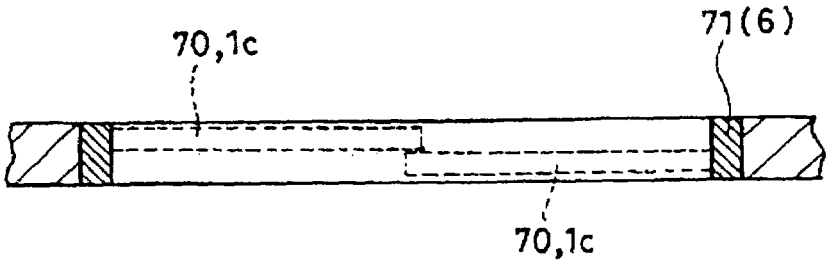
FIG. 6 is a sectional view of FIG. 5.
Figure 7:
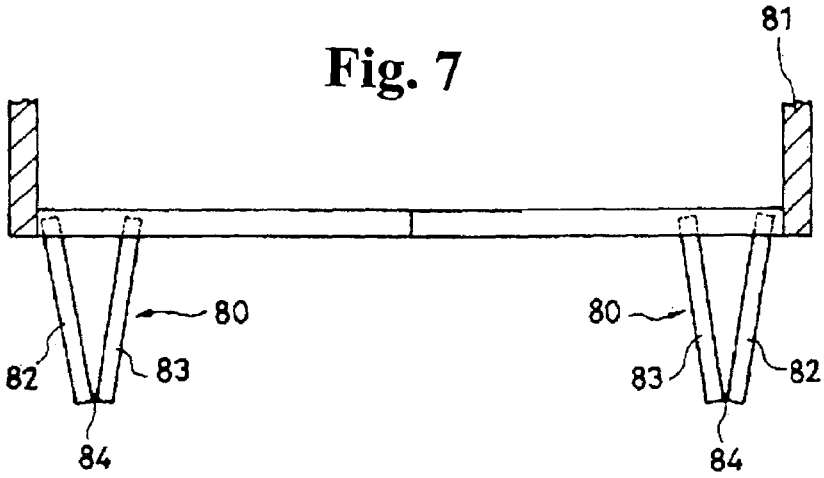
FIG. 7 shows a third working example, and the same drawing is a sectional view of a folding door.
Figure 8:
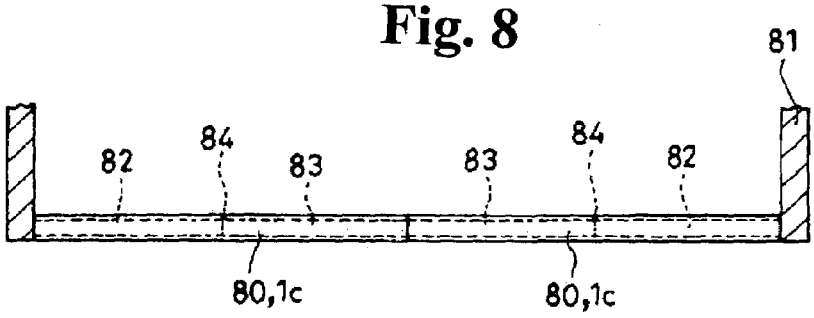
FIG. 8 is a sectional view showing the state in which the folding door in FIG. 7 is closed.
Figure 9:
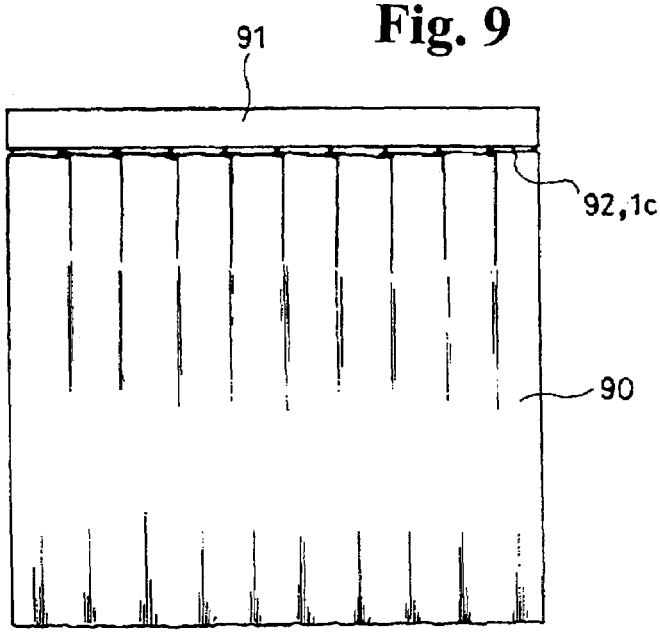
FIG. 9 shows a fourth working example, and the same drawing is a front view of a curtain.
Figure 10A:
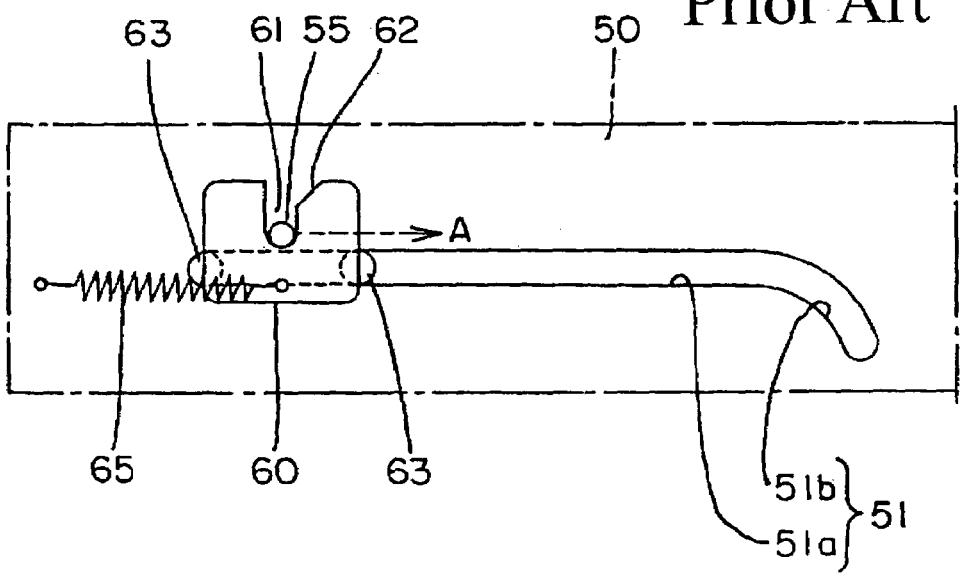
Fig. 10(a) Prior Art
FIG. 10 is a reference drawing for explaining the problems of the past.
Figure 10B:
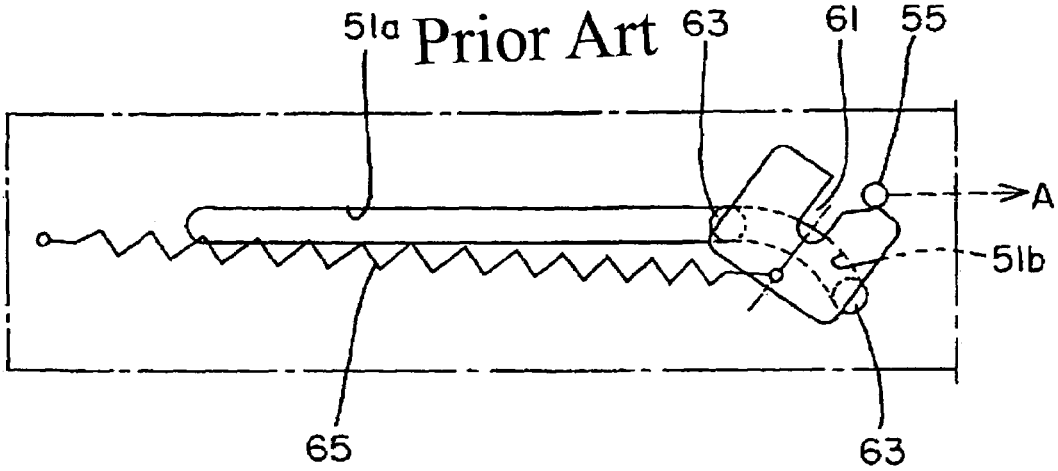
Fig. 10(b) Prior Art

FIGS. 5-6 show a second working example. Specifically, FIG. 5 shows a front view of a window, and FIG. 6 shows a sectional view of the window in FIG. 5. FIGS. 7-8 show a third working example. Specifically, FIG. 7 shows a sectional view of a folding door, and FIG. 8 shows a sectional view of the state in which the folding door in FIG. 7 is closed. Finally, FIG. 9 shows a fourth working example, with the same drawing showing a front view of a curtain.

Figure 4:
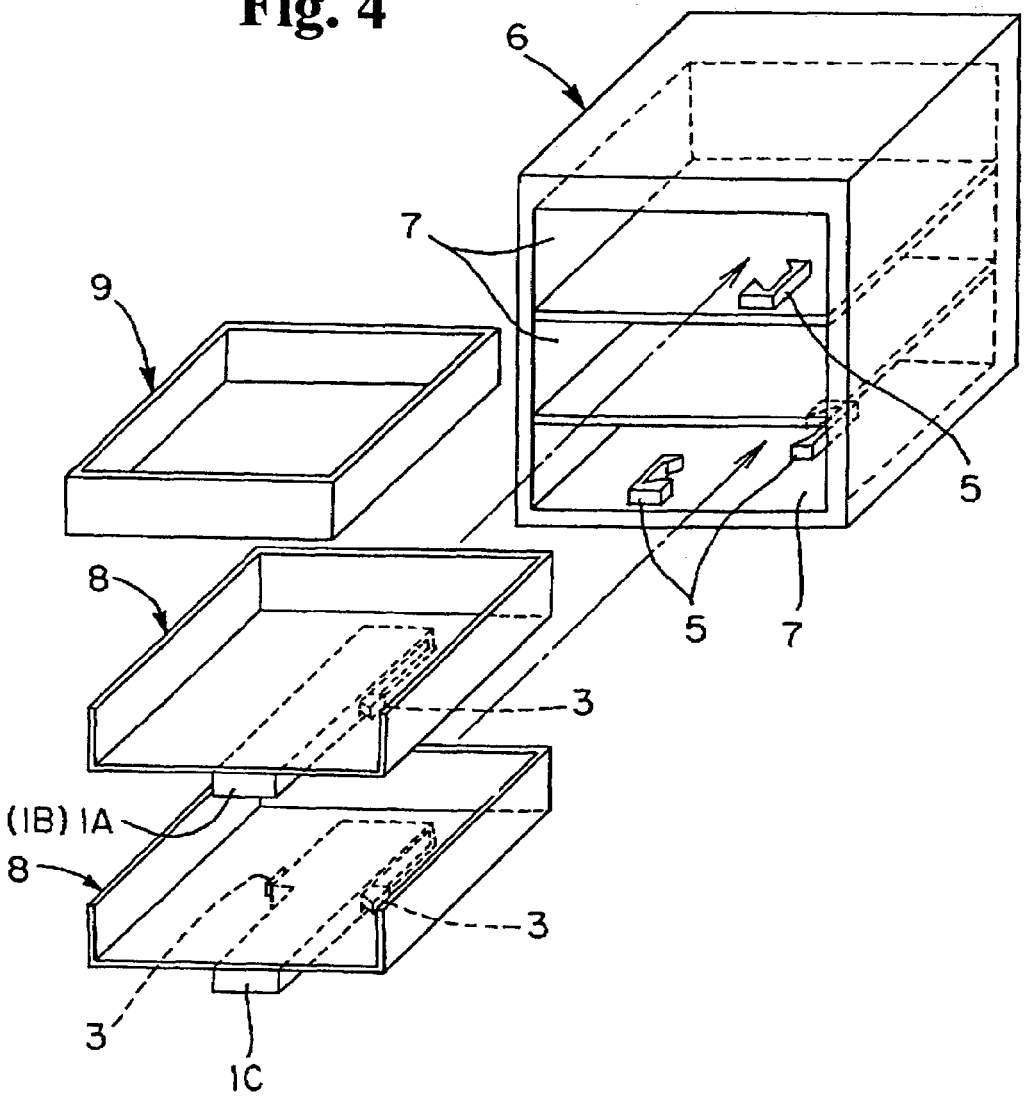
FIG. 4 is a reference drawing showing the relationships, and the like, of the movable body and the base in the first working example.

Referring to FIG. 4, the sliding assisting apparatus of the present invention, in brief, includes a drawing-out dedicated unit main body 1A, a drawing-in dedicated unit main body 1B, and/or a drawing-out/drawing-in dual-use unit main body 1C. The sliding assisting apparatus also includes an operation member 5, for assisting the operation of switching the sliding of the movable body on the base between the drawn-in position and the drawn-out position.

FIG. 4 shows one example of the base and the movable body. This base 6 is a storage apparatus having space parts 7 opened on the front formed on multiple levels. The movable body 8 has a drawer 9 which is attached inside so as to be capable of installation and removal, and it is assembled into the corresponding space part 7 of the base 6 so as to be switched to slide between the drawn-in position and the drawn-out position. In this example, any one of the drawing-out dedicated unit main body 1A, the drawing-in dedicated unit main body 1B, or the drawing-out/drawing-in dual-use unit main body 1C, is attached on the movable body 8, and the operation member 5 is attached on each space part 7 in correspondence with the unit main body.

FIG. 1 illustrates an exemplary sliding assisting apparatus for a drawing-out/drawing-in dual-use unit main body 1C. The perspective illustrated therein is a side view of the device, showing a view of a space part 7 from the right side of base 6 shown in FIG. 4.

In the sliding assisting apparatus in FIG. 1, the drawing-out/drawing-in dual-use unit main body 1C is attached on the bottom surface side of the movable body 8, with one operation member 5 attached on the inside bottom surface side of the space part 7, and one operation member 5 attached on the inside left top surface side of the space part 7.

The unit main body 1C also includes two sliders 2 which respectively are capable of sliding in the same direction as the movable body 8, two lock members 3 which are built into the respective top and bottom sliders 2, and are capable of being displaced to sway in a direction roughly orthogonal to the sliding direction of the movable body 8, meaning in the up-down directions, and a spring member 4 which is capable of accumulating force in the process of sliding of the movable body 8. The foregoing items are built into a case 10C.

Case 10C has a rectangular container shape which is long in the sliding direction of the movable body 8 and is flat as depicted in FIG. 1. On one side wall of case 10C, of the two side walls shown facing oppositely in the lengthwise direction, the side back from approximately the middle front to the back sticks out by an amount corresponding to a vertical wall 16. Also, on both side walls, a long groove 11 is formed from about the middle position in the front-to-back direction to the back end as shown in FIG. 1.

On the inside bottom surface, the device has a roughly circular dividing rib 17 for damper placement in approximately its middle front to its back, and front-to-back ribs 18*a*, 18*b* which extend from the back side to near approximately the middle position between the front and back. A damper 35 is placed inside the dividing rib 17. The dividing rib 17 forms a damper receiving part, with one part serving as a step part. This damper receiving part functions as in the present embodiment, and is made to be capable of rotating a base 36 of the damper 35 in only one direction via teeth or projections on the side of the base and the step part on the side of the rib 17. In terms of shape, this item is not limited to the shape in FIG. 1 and, for example, may also be designed in a shape such that the dividing rib 17 is rotated about 90 degrees. Also, the two front-to-back ribs 18*a*, 18*b* extend from the rear wall to near the vertical wall 16, and the front sides of the ribs are connected together.

A step-shaped restricting part 19*a* is provided on the front end side of the front-to-back rib 18*a*. A step-shaped restricting part 19*b* is provided likewise on the back end side of the front-to-back rib 18*b*. Each restricting part 19*a*, 19*b* is used for locking the lock member 3 on its vertical wall. The above case 10C, after incorporating the pair of sliders 2 and the lock members 3 as well as the spring member 4, is attached to the bottom surface of the movable body 8 by a setscrew, or the like.

The damper 35 idle-rotates when it rotates counterclockwise as shown in FIG. 3(*a*), and it damps the member on the other side (slider 2) via a gear 37 when it rotates clockwise as in FIG. 3(*c*). Also, the construction in this structure includes the base 36 made to be idle-rotated in one direction via the teeth on the outer perimeter, whereby it damps only when the movable body 8 is slid by the force of the spring member 4, as described below.

Each slider 2 has a long piece part 20 which forms a rack 24, and a holding part 22 which is provided at the back end of the long piece part 20 and supports the lock member 3. Also, on bottom slider 2, a spring anchoring part 25 is provided on its holding part 22. Top slider 2 has a front end bent part 26 in which the front end of the long piece part 20 is bent roughly in an L shape, and a step-shaped attachment piece part 27 which is made to project out on the front inside surface of that front end bent part 26. Also, the sliders 2 are disposed inside the case 10C such that the rack 24 of each faces opposite the other. Also, the damper 35 is attached in a manner such that the gear 37 is disposed between the racks 24 of the respective sliders 2, and in addition, normally engages with at least one of the two racks 24.

Each lock member 3 is placed such that it elastically contacts with an inner part 22*b* of a holding part 22 via two elastic pieces 30, with a striking part 31 made to project out from holes 23. Accordingly, each lock member 3 is also placed on the holding part 22 in an up/down direction orthogonal to the sliding direction of the slider 2, and becomes capable of moving to accompany the elastic deformation of the two elastic pieces 30.

Usually, as shown in FIG. 1, the lock member 3 of the bottom slider 2 is placed in the unlocked position with its head part 32 lightly contacting with the side surface of the front-to-back rib 18*b*, and the lock member 3 of the top slider 2 is placed with its head part 32 on the step-shaped restricting part 19*a* of the front-to-back rib 18*a*, that is, in the locked position, where the movable body and the corresponding slider are operationally linked.

The spring member 4 is a constant-pressure spring in which a spring plate 42 wound around a spool 41 is drawn out from a housing 40, which is attached on the step-shaped attachment piece part 27 of the top slider 2. Also, the drawn-out end of the spring plate 42 of the spring member 4 is fixed on the anchoring part 25 provided on the holding part 22 of the bottom slider 2.

The same number of operation members 5 as the sliders 2 or lock members 3, namely, two, are used. Each operation member 5 is capable of switching the corresponding lock member 3 from the unlocked position (the position in which the operational linkage between the movable body and the corresponding slider is released) to the locked position by a first cam part 47 as shown in each FIGS. 2(*b*) and 3(*b*). Second cam parts 48 enable the operation members 5 to switch the corresponding lock members 3 from the locked position to the unlocked position as shown in each FIGS. 2(*c*) and 3(*c*).

FIGS. 2 and 3 respectively show the main operations when using the sliding assisting apparatus. FIG. 2(*a*) illustrates the state in which the movable body 8 is in the course of being drawn out manually from the drawn-in position, where it is held in the space part 7 on the side of the base as shown in FIG. 1. In this process, the lock member 3 of the bottom slider 2 is in the unlocked position with respect to restricting part 19*b*, and the lock member 3 of the top slider 2 is in the locked position with respect to restricting part 19*a*. Because the movable body 8 is drawn out while the damper 35 is idle-rotated, and the bottom slider 2 is restricted in position via its engaging lock member 3 and operation member 5, the spring member 4 accumulates force in a gradually increasing manner accompanying the sliding of the movable body 8.

FIG. 2(*b*) is the state in which the movable body 8 has been further drawn out and is immediately after the lock member 3 of the bottom slider 2 has been switched to the locked position by its interaction with its corresponding operation member 5. In this process, the lock member 3 of the bottom slider 2 is displaced to sway to the locked position as a result of a contact between the striking part 31 and the cam surface of the first cam part 47, with the sliding of the striking part 31 in the direction of the restricting part 19*b* by the cam action of the cam surface.

FIG. 2(*c*) shows the state in which the movable body 8 has been further drawn out and is immediately after the lock member 3 of the top slider 2 has been switched to the unlocked position by its corresponding operation member 5. In this process, the lock member 3 is displaced to sway to the side of the long piece part 45, namely, the unlocking direction, as a result of a contact between the striking part 31 to the cam surface of the second cam part 48 of its corresponding operation member 5, with the sliding of the striking part 31 by the cam action of the cam surface.

FIG. 2(*d*) is the state in which the lock member 3 of the top slider 2 has been switched to the unlocked position, meaning the position in which the operational linkage between the movable body 8 and the slider 2 is released. Here, the movable body 8 has been slid automatically by the force of the spring member 4 up to its final drawn-out position on the corresponding slider 2, which has been restricted in position by the corresponding operation member 5. In this structure, while going from the positions of FIG. 2(*c*) to FIG. 2(*d*), the damper 35 damps the sliding speed of the movable body 8 via the engagement between the rack 24 of the top slider 2 and the gear 37. As a result, the movable body 8 is slid at a moderate speed from the mid-course position to the final drawn-out position.

FIG. 3(*a*) shows the state when the movable body 8 is operated to be drawn-in to the mid-course position from the drawn-out position shown in FIG. 2(*d*). In the aforementioned drawing-in process, in the initial stage, because the top slider 2 is restricted in position via its corresponding lock member 3 and operation member 5, the spring member 4 accumulates force in a gradually increasing manner accompanying the sliding of the movable body 8. Also, at the stage when the lock member 3 of the top slider 2 has reached the restricting part 19*a* from the front-to-back rib 18*a* as shown in the same figure, the striking part 31 contacts with the cam surface of the first cam part 47, and the lock member 3 is displaced to sway in the direction of the restricting part 19*a*, namely, the locked position, by the cam action of that cam surface.

FIG. 3(*b*) shows the state in which the lock member 3 of the top slider 2 has been switched to the locked position. In this state, because the lock members 3 of the respective sliders 2 are both in the locked position, the movable body 8 and the respective sliders 2 are slid as one in the drawing-in direction.

FIG. 3(*c*) shows the state in which the movable body 8 has been operated to be drawn-in up to the mid-course position and the lock member 3 of the bottom slider 2 has been switched to the unlocked position. That is, in this drawing-in process, when the lock member 3 of the bottom slider 2 has passed over the first cam part 47 of its corresponding operation member 5 as noted with respect to FIG. 3(*b*), the striking part 31 contacts with the second cam part 48 of the operation member 5, and by the cam action of the cam surface, the lock member 3 is slid to the lower position, that is, to the side of the long piece part 45 of lower operation member 5, whereby it is switched to the unlocked position.

FIG. 3(*d*) shows the state in which the lock member 3 of the bottom slider 2 has been switched to the unlocked position, whereby the movable body 8 has been slid automatically by the force of the spring member 4 up to the final drawn-in position on the bottom slider 2, restricted in position by its corresponding operation member 5. In this structure, while going from the position of FIG. 3(*c*) to FIG. 3(*d*), the damper 35 damps the sliding speed of the movable body 8 via the engagement between the rack 24 and the gear 37. As a result of the foregoing, the movable body 8 comes to be slid at a moderate speed from the mid-course position to the final drawn-in position.

In the present first working example, the unit main body 1C may be attached on the base 6, for example, the inside bottom surface of the space part 7, and the operation member 5 may be attached to the movable body 8. In this modified example, the relationship of the members in FIG. 2 becomes a relationship as if viewing the drawing from the back side of the page.

Also, the present invention is not limited whatsoever to the noted first and modified embodiments. For example, referring to the damper 35, as disclosed the device is simplified such that the rotational direction is restricted by setting of the shape of the base 36 on the damper receiving part such that it damps only when rotating in one direction, the structure should not be taken as limiting, and there are no problems even if other structures/functions are employed. Also, with respect to the enclosed spring member 4, although an example of a constant-pressure spring has been given, any other spring may be used, including a coil spring or other forcing structure.

The present invention is not limited to the front-back sliding types described, for example, sliding in the front-back direction, or to the structures described, such as a drawer 9. For example, the base 6, although not illustrated, may be a storage part of furniture, where the movable body 8 becomes a drawer or sliding table attached in the storage part capable of being drawn out. The furniture, although not illustrated, may be a system kitchen, where the movable body 8 becomes a drawer or sliding table attached in the storage part of the system kitchen capable of being drawn out.

In addition, though not illustrated, the furniture may be a PC desk, where, the movable body 8 becomes a drawer, sliding table or keyboard table attached to the PC desk, capable of being drawn out. The furniture, although not illustrated, may also be a chest of drawers, where the movable body 8 is a drawer or sliding table attached to the chest of drawers capable of being drawn out.

The base 6, though not illustrated, may also be a storage part of a home electric appliance, where the movable body 8 becomes a drawer attached in the storage part capable of being drawn out. The home electric appliance, though not illustrated, may be a refrigerator, where the movable body 8 is a drawer of the refrigerator. Here, the refrigerator conceptually includes a freezer. The movable body 8, though not illustrated, may also be a drawer of a middle case inside a refrigerator. The home electric appliance, although not illustrated, may be an information appliance, for example, such as a copy machine, fax machine, copy machine or combined machine, where the movable body 8 is a paper feed tray.

The base 6 may be an office desk, where the movable body 8 becomes a drawer of the office desk. The base 6 may also be an office cabinet, where the movable body 8 becomes a drawer of the cabinet. Though not illustrated, the base 6 may be a storage part of an ashtray in a car, where the movable body 8 becomes a drawer type ashtray attached in the storage part capable of being drawn out. Base 6 may also be an ashtray or the storage part of a cup holder, in a car, where the movable body 8 becomes a drawer type cup holder attached in the storage part capable of being drawn out. The base 6 may be a console, for example, such as a center console in a car, where the movable body 8 becomes a drawer type console lid attached to the console capable of being drawing out. The base 6 may also be a cash register, where the movable body 8 becomes a drawer of the cash register.

Other implementations including the drawer 6 being (i) a drawer or drawer type sliding table of furniture; (ii) a drawer or drawer type sliding table of cupboard; (iii) a drawer, drawer type sliding table, drawer type keyboard table of various kinds of desks such as writing desk, school desk, office desk, PC desk; (iv) a drawer type water supply tank of a refrigerator (freezer); and (iv) a drawer type ice machine or ice chest of a refrigerator (freezer).

Referring to FIGS. 5 and 6, a window 70 as one example of a movable body 8. Here, left and right windows 70 are supported to be drawn contrarily on a window frame 71 serving as the base 6. The unit main bodies 1C are attached respectively on the left and right windows 70. That is, a unit main body 1C is fixed on at least either one of the upper and lower surfaces of each window 70.

In one non-illustrated embodiment, the operation member 5 which couples with the lock member 3 of the unit main body 1C may be fixed on the upper or lower frame of the window frame 71. When the left or right window 70 is closed, the lock member 3 couples with the operation member 5 in mid-course, whereby the left or right window 70 is assuredly closed by the spring returning force accumulated in the spring member 4. On the other hand, when the left or right window 70 is opened, the lock member 3 couples with the operation member 5 in mid-course, whereby the left or right window 70 is assuredly opened by the spring returning force accumulated in the spring member 4.

Referring to FIGS. 7 and 8, a folding door 80 is illustrated as one embodiment of a movable body 8. Both ends, left and right, of left and right folding doors 80, are slidably supported in the left-right direction on a closet 81 serving as the base 6. Each folding door 80 includes two doors, namely an outside door 82 and a center door 83, with the outside door 82 and the center door 83 being folded up in a V shape by means of a hinge 84.

In one non-illustrated embodiment, slide rails are fixed on the top and bottom of the closet 81, and the ends on the sides that are to the left and right of the outside door 82 and the center door 83 respectively are slidably supported on the upper and lower slide rails.

Unit main bodies 1C may be attached respectively on the left and right folding doors 80. That is, a unit main body 1C is fixed on at least either one of the upper and lower surfaces of each folding door 80. On the other hand, though not illustrated, the operation member 5 which couples with the lock member 3 of the unit main body 1C may be fixed on the upper or lower frame of the closet 81.

When the left or right folding door 80 is closed, the lock member 3 couples with the operation member 5 in mid-course, whereby the left or right folding door 80 is assuredly closed by the spring returning force accumulated in the spring member 4. On the other hand, when the left or right folding door 80 is opened, the lock member 3 couples with the operation member 5 in mid-course, whereby the left or right folding door 80 is assuredly opened by the spring returning force accumulated in the spring member 4.

Referring to FIG. 9, a curtain 90 is illustrated as one example of a movable body 8. A curtain rail 92 serving as the base 6 is fixed on the upper frame 91. Also, although not illustrated, a curtain 90 is hung on the curtain rail 92 by means of a curtain runner.

The unit main body 1C may be attached to the curtain 90 using the runner. On the other hand, in a non-illustrated embodiment, the operation member 5 which couples with the lock member 3 of the unit main body 1C may be fixed on the upper frame.

When the curtain 90 is closed, the lock member 3 couples with the operation member 5 in mid-course, whereby the curtain 90 is assuredly closed by the spring returning force accumulated in the spring member 4. On the other hand, when the curtain 90 is opened, the lock member 3 couples with the operation member 5 in mid-course, whereby the curtain 90 is assuredly opened by the spring returning force accumulated in the spring member 4.

There are numerous examples of left-right sliding type embodiments, where sliding in the left-right direction is performed, for the operation of a window 70, folding door 80 or curtain 90.

In numerous embodiments, the movable body may refer to numerous real-life items. In particular, the movable body may comprise any one of these items: (1) a storm door of a building, (ii) a shutter of a building, (iii) a sliding door (indoor or outdoor) of a building, (iv) a bathroom door, (v) a movable space partition, (vi) a sliding door of a middle case of a refrigerator (including a freezer as well), (vii) a moving rack that slides left and right, (viii) a sliding door of an automobile, (ix) a sliding door of a display refrigerator (including a freezer as well), (x) a sliding type opening-and-closing door of cupboard, (xi) a sliding type opening-and-closing door of clog cabinet, (xii) a sliding type opening-and-closing door of bookshelf, (xiii) a sliding type opening-and-closing door of vehicle such as an electric train/trolley, (steam) train, ship, airplane, or the like.

The movable body 8, although not illustrated, is not limited to movement in the left-right directions, and also may be slid in the up-down direction, with one sliding position as an ascended position and the other sliding position as a descended position. Examples of an up-down sliding type operation where sliding occurs in the up-down direction, include (i) an ascending-descending type shutter of a building, (ii) an ascending-descending type window of a building, (iii) an ascending-descending type blinds, and (iv) an ascending-descending type moving rack.

The disclosure of Japanese Patent Application No 2004-213628, filed on Jul. 21, 2004, is incorporated in the application.

While the invention has been explained with reference to the specific embodiments, the explanation is illustrative and the invention is limited only by the appended claims.

What is claimed is:

1. A sliding assisting apparatus for assisting a sliding operation, said apparatus comprising:

a movable body slidably engaged with a base, said movable body configured to be slid between a first sliding position and a second sliding position;

a plurality of sliders engaged with the movable body and capable of sliding in same directions as the movable body;

a spring member capable of accumulating force in the sliding operation of the movable body and connecting said respective sliders together;

a plurality of lock members, each capable of engaging with one of said sliders to exert said accumulated force on said slider, and capable of disengaging from said one of said sliders to release said accumulated force from said slider; and a plurality of operation members, each capable of engaging and disengaging with one of said lock members for engaging said lock member with one of said sliders and disengaging said lock member from said slider.

2. The apparatus according to claim 1, further comprising engaging means, said plurality of sliders including a first slider, and a second slider located under the first slider, said engaging means slidably engaging the first and second sliders.

3. The apparatus according to claim 2, wherein said lock members include first and second lock members and are arranged such that during the sliding operation between a first midcourse position and a second midcourse position, the first lock member is engaged with said first slider and the second lock member is engaged with said second slider.

4. The apparatus according to claim 2, wherein said lock members include first and second lock members and are arranged such that during the sliding operation between the second drawn-out position and a first midcourse position, the first lock member is disengaged from said first slider and the second lock member is engaged with said second slider.

5. The apparatus according to claim 2, wherein said lock members include first and second lock members and are arranged such that during the sliding operation between a second midcourse position and the first drawn-in position, the first lock member is engaged with said first slider and the second lock member is disengaged from said second slider.

6. The apparatus according to claim 2, further comprising a case for housing the plurality of sliders, the spring member and a plurality of lock members.

7. The apparatus according to claim 2, wherein:

the base comprises any one of:

a window frame;

a closet;

a curtain rail; and the movable body comprises a window, a folding door and a curtain, respectively.

8. The apparatus according to claim 1, wherein:

the movable body slides any one of:

a front-back direction;

a left-right direction; and an up-down direction; and said first sliding position is any one of:

a drawn-in position;

an open position; and an ascended position; and said second sliding position is any one of:

a drawn-out position;

a closed position; and a descended position.

9. The apparatus according to claim 1, wherein:

the base comprises a storage part of a furniture component; and the movable body comprises any one of a drawer and a sliding table, attached in said storage part capable of being drawn out.

* * * * *